United States Patent [19]

Olsen et al.

[11] 4,406,336

[45] Sep. 27, 1983

[54] DRILLING BIT

[76] Inventors: John K. Olsen, 4494 Trout Dr. Southeast; William R. McGinnis, 5801 Bahama Shores Dr. South; Barbara H. Olsen, 4494 Trout Dr. Southwest, all of St. Petersburg, Fla. 33705

[21] Appl. No.: 232,958

[22] Filed: Feb. 9, 1981

[51] Int. Cl.[3] ..... E21B 10/62

[52] U.S. Cl. ..... 175/410; 175/418; 175/327

[58] Field of Search ..... 175/374–375, 175/410, 417–418, 393, 329, 327, 409, 412; 76/108 R, 108 A, 108 T

[56] References Cited

U.S. PATENT DOCUMENTS

| | | | |
|---|---|---|---|
| 2,631,824 | 3/1953 | Annesley | 175/409 |
| 3,982,596 | 9/1976 | Vetter | 175/410 |
| 4,244,432 | 1/1981 | Rowley et al. | 175/410 X |

OTHER PUBLICATIONS

Smith-Williston, Inc., 3 Reasons Why S/W Drills Offer Higher Drilling Rates at a Lower Per Foot Cost, Nov. 16, 1973.

*Primary Examiner*—Ernest R. Purser
*Assistant Examiner*—Thuy M. Bui
*Attorney, Agent, or Firm*—Walter J. Monacelli

[57] ABSTRACT

The device described herein comprises a bit for drilling oil wells, water wells, foundation sockets for bridges and buildings, air and utility shafts for mines, etc., which bit comprises an inner core or mandrel and an outer shell or exterior sleeve, which shell or sleeve is replaceable when worn. The inner core resembles in many features, the standard type of bit in present use in that the means for holding, supporting and driving the bit are similar to those in present practice, and has appropriate openings and means for blowing air and/or liquid through the bit to blast away rock dust and cuttings. The novelty of the new device resides in having a lower annular end of the core preferably slightly tapered inwardly toward the extreme end, and having fitted over this annular section a sleeve or shell whose inner surface is preferably also slightly tapered, corresponding in size and shape to and in close contact with the said annular section of the core thereby providing a tight fit. The lower exterior surface of this shell has small openings about 0.375–1.25 inches in diameter into which hard "compacts" preferably of tungsten carbide, are fitted. These compacts are rounded on the exposed end and are adapted to provide a grinding, cutting and chipping action against the rock or surface into which the bit is pressed and rotated. Grooves in the sides and bottom of the shell allow passage of dust and cuttings along with air and/or liquid which has been blasted through the interior openings of the core.

5 Claims, 2 Drawing Figures

FIG. 1
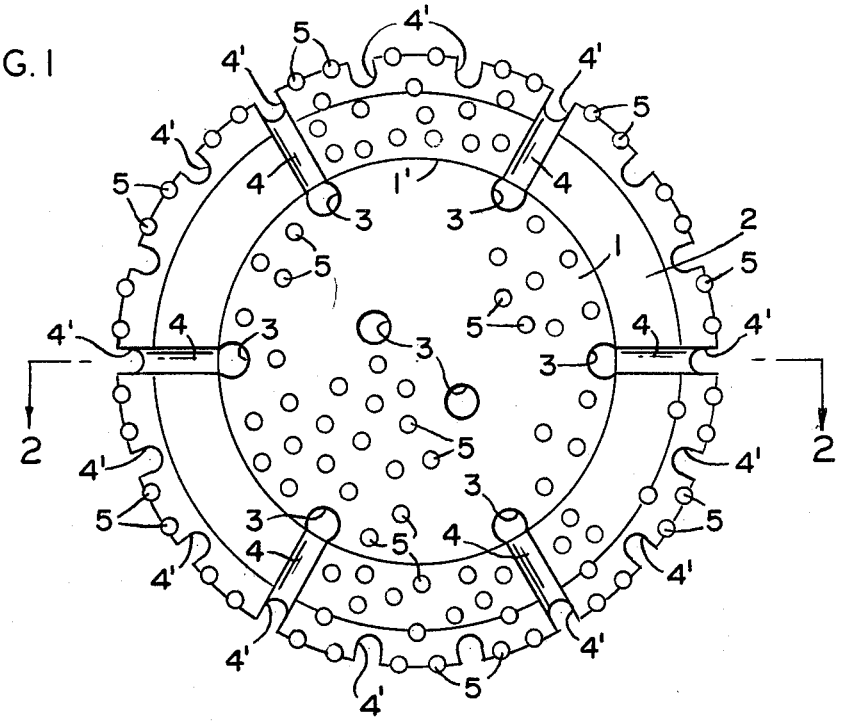
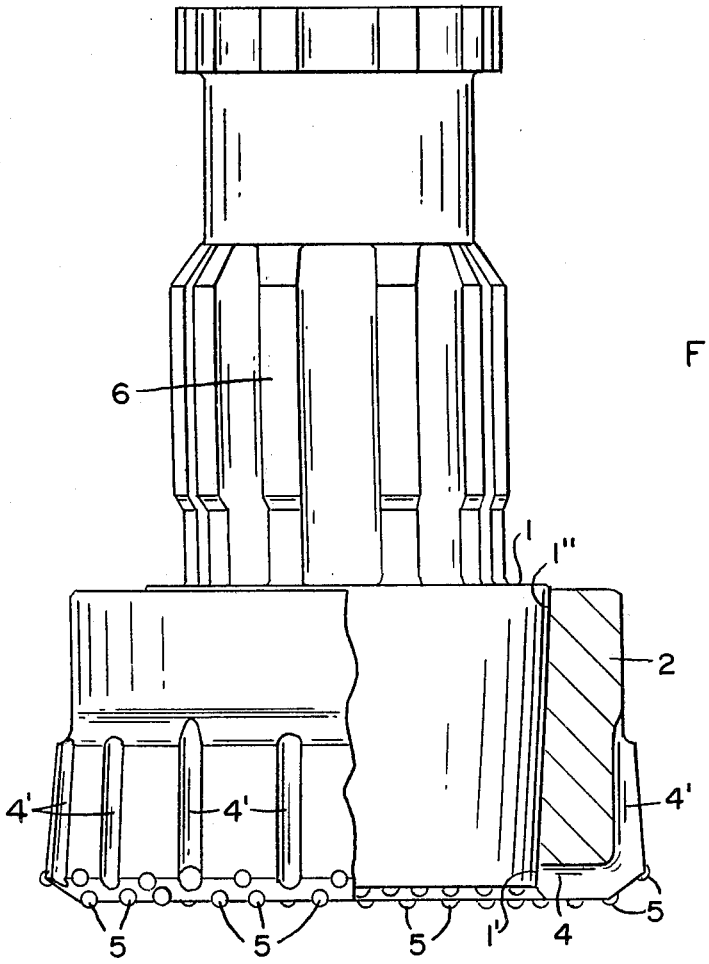
FIG. 2

DRILLING BIT

BACKGROUND OF THE INVENTION

1. Field of the Invention

This invention relates to a bit designed for drilling through rock and other hard surfaces, for example as used in drilling oil wells, etc. More specifically, it relates to a drill bit comprising an inner core or mandrel and an exterior sleeve or shell adapted to fit over the extreme lower end of the core. Still more specifically, the device of this invention may be fabricated from previously used or new bits.

2. State of the Prior Art

Drill bits are known and presently used which have carbide "compacts" deposited in openings in the lower exterior surface of the bit to provide hard grinding and chipping surfaces. Moreover, such bits are provided with linear openings therein through which air and/or liquid may be delivered to the areas being drilled to blast away dust and cuttings. Such drill bits are illustrated by those described in U. S. Pat. Nos. 2,725,216 and 3,185,228.

However, the carbide compacts used in such bits become worn and are thereby rendered inefficient or useless in the drilling operation, particularly in the outer areas of the bottom of the bit where the rotational speed of the bit is the greatest because this area is farthest from the axis of rotation. Therefore once these compacts are rendered inefficient for drilling purposes, even if only in the described outer areas, the complete bit must be discarded and replaced.

SUMMARY OF THE INVENTION

In accordance with the present invention, it has been found that the disadvantages of having to discard and replace a whole bit may be avoided by having the bit designed in two parts, namely: (1) an inner core or mandrel having appropriate means for supporting and driving the bit and also linear openings therethrough to permit air and/or liquid to be blown through to the area being drilled, the lower portion of said core or mandrel having an outer circular cross-section or annular shape, and (2) a sleeve or shell adapted to fit tightly around the lower extremity of the core which shell have openings in the lower extremity thereof into which "compacts" of hard materials are deposited to provide the grinding and cutting action desired. These compacts are cylindrical with a protruding end being hemispherical in shape. Advantageously, the lower extermity of the core provides an annular, preferably tapered, surface around which the inner surface of the shell provides a close fit, also preferably with a taper corresponding to and in intimate contact with the annular area of the core. Moreover, the fit and design of the shell is such that its lower surface having the hard compact fixed therein will be in the same plane as the extreme lower surface of the core so that hard compacts similarly fixed in this surface will also function in the grinding and cutting operation.

The device of this invention is therefore designed so that when the hard compacts at the bottom thereof become worn and reduced in efficiency, the sleeve or shell may be removed and replaced by another unworn sleeve or shell of similar design thereby rendering the bit to renewed high efficiency. Moreover, while it is contemplated that the core and shell may be initially manufactured as described above, it is also contemplated that one of the greatest uses of the design of this invention may be in the conversion of worn bits presently in use to serve as cores in the device of this invention. For example, a worn bit may be ground or shaved in the lower region thereof to provide the annular surface described above. Then onto this annular surface there may be fitted the appropriate sized sleeve or shell to construct the device of this invention. In adapting worn bits of prior art design to serve as cores for this purpose, sufficient of the lower part of the bit should be removed so that the sleeve or shell will provide sufficient new grinding surface and compacts, particularly if the grinding and cutting width of the new device is to be about the same as the grinding width of the original bit. However, it will be obvious that a sleeve or shell may be used on a used or new bit converted to an inner core of the present device which gives a diameter greater or less than that of the original bit. It is also obvious therefore that a standard core may be used to fit a variety of sleeves or shells having increasing or decreasing diameters.

The bits of this invention may range from the 3 inches to 48 inches, or even higher in overall cross-sectional diameter in the lowest section. More practically, the size is in the range of 6–48 inches. The outer sleeve or shell will generally be 1.5–15 inches thick.

BRIEF DESCRIPTION OF THE DRAWINGS

The drill bit of this invention may be illustrated by reference to the accompanying drawings in which:

FIG. 1 is a bottom assembled view of the core and shell device of this invention;

FIG. 2 is a side elevational assembled view of the core and shell device of this invention with a cutaway section taken at line 2—2 of FIG. 1, showing the annular section of the core onto which the shell is fitted.

DETAILED DESCRIPTION

FIG. 1 shows the bottom of inner core 1 onto which shell 2 is tightly fitted. Openings 3 extend from the top to the bottom of the core or mandrel through which air and/or liquid are blown to blast away dust particles and cuttings through channels or grooves 4 which extend to the outer edge of the bit. Grooves or channels 4' extend vertically upward along the outside of the shell. Carbide "compacts" 5 are fitted into openings drilled into the bottom of the core and bottom and side of shell 2.

FIG. 2 shows the assembled device with outer shell 2 fitted onto inner core or mandrel 1. The shape and configuration of the upper portion 6 of the mandrel resembles those of presently used bits. In the preferred modification shown in FIG. 2, the annular surface of core 1 is slightly tapered so that the bottom has a cross-sectional diameter of 1' slightly less than that at the upper section 1''. For example, a typical mandrel may have a 16 inch diameter at the bottom and 17 inch diameter at upper portion 1''. The inner diameters of the shell are corresponding about 16 inches at the bottom and 17 inches at the top with a thickness of 3–15 inches from the inside to the outside of the shell.

When the shell is fitted onto the core, the shell is first advantageously heated to 400°–500° F. for expansion and relief of stresses. The core is kept at room or ambient temperature, or may even be chilled or cooled just prior to fitting of the shell thereon. When the heated shell is applied onto the core and allowed to cool, a very tight fit is provided so that a very tight grip of the shell onto the core is effected. While this means is preferred, other methods of fixing the shell on the core are contemplated. For example, holes may be drilled through the shell into the core and bolts, pins or keys inserted to fix shell into position.

In any case, the tight fit described above is satisfactory through all the rotational and drilling operations to which such bits are exposed.

Likewise, when the carbide compacts are inserted, the metal in which the openings have been drilled, generally about 0.375–1.25 inches diameter, is heated to expand the openings and the carbide compacts with about 0.002–0.003 inch interference fit are inserted and driven in if necessary. When the metal cools and contracts, the compacts are tightly grasped, sufficiently to withstand the grinding, cutting and chipping operations to which they are exposed. The steel from which the cores and shells are made are advantageously of about 38 Rockwell C hardness.

In converting a used or worn bit to serve as the core or mandrel of this invention, any appropriate means may be used to machine or grind the old bit to the desired shape and size.

When the shell has become worn and it is desired to replace the same, it may be removed by hammering the top edge, preferably after heating the shell to cause expansion thereby facilitating removal. If bolts, pins or keys have been inserted to secure attachment of the shell, the bolts or pins may be removed by unscrewing the same or by drilling them out. Then a new shell is attached as described above.

While certain features of this invention have been described in detail with respect to various embodiments thereof, it will of course be apparent that other modifications can be made within the spirit and scope of this invention and it is not intended to limit the invention to the exact details shown except insofar as they are defined in the following claims.

The invention claimed is:

1. In a bit adapted for drilling through rock or other hard materials having an upper portion appropriate in size and configuration for being operated and manipulated in a drilling operation and having linear openings therein through which air and/or liquid may be blown to blast away dust, clippings and cuttings accumulated during the drilling, the improvement comprising:

(1) a lower core section having a smooth annular exterior surface; and (2) an annular shell having its interior surface smooth and of a shape and size adapted to fit tightly onto the smooth exterior annular surface of said core section, said shell being separable by downward movement from said lower core section and having openings in the bottom and lower side section thereof into which openings compacts of hard material of appropriate size are tightly fitted.

2. The bit of claim 1, in which said compacts are tungsten carbide.

3. The bit of claim 2, in which the bottom of said core section also has openings into which tungsten carbide compacts have been tightly fitted.

4. The bit of claim 1, in which the annular exterior surface of said lower core section has a slightly smaller circular cross-section in the lowest portion thereof than the circular cross-section of the upper portion of said annular exterior surface.

5. The bit of claim 4, in which the interior surface of said annular shell likewise has a slightly smaller circular cross-section in the lowest portion of the interior surface of said annular shell than the circular cross-section at the upper portion of said annular shell.

* * * * *